US006287513B1

(12) United States Patent
Grady et al.

(10) Patent No.: US 6,287,513 B1
(45) Date of Patent: Sep. 11, 2001

(54) METHOD OF SHAPING POWDER METAL PARTS

(75) Inventors: Thomas G. Grady, deceased, late of Indianapolis, by Peggy Grady, legal representative; Tom L. Stuart, Pendleton; Scott M. Clase, Indianapolis; Bradley D. Beard, Yorktown, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/379,689

(22) Filed: Aug. 24, 1999

(51) Int. Cl.[7] ..... B22F 3/00
(52) U.S. Cl. ..... 419/37; 419/35; 419/48
(58) Field of Search ..... 419/35, 36, 37, 419/48

(56) References Cited

U.S. PATENT DOCUMENTS 4,834,800 * 5/1989 Semel ..... 106/403
5,271,891 * 12/1993 Gay et al. ..... 419/36
5,567,746 * 10/1996 Gay ..... 523/220
5,591,373 * 1/1997 Ward et al. ..... 252/62.54
5,595,609 * 1/1997 Gay ..... 148/104
5,637,402 * 6/1997 Gay ..... 428/403

* cited by examiner

*Primary Examiner*—Ngoclan Mai
(74) *Attorney, Agent, or Firm*—Margaret A. Dobrowitsky

(57) ABSTRACT

Disclosed is a method of shaping powdered metal parts comprising:

(a) providing powdered metal from a source;

(b) applying a heated fugitive coating to the powdered metal;

(c) passing the powdered metal through a heated tube from a supply thereof to the die for the molding of the part;

(d) monitoring the temperature of the heated tube during the passage of the powdered metal there through;

(e) heating the die and monitoring the temperature thereof;

(f) heating a punch die and monitoring the temperature thereof;

(g) after filling the die with coated powdered metal, compacting the powdered metal by applying pressure from the punch die to the filled die thereby compacting the metal to a desired shape.

7 Claims, 4 Drawing Sheets

METHOD OF SHAPING POWDER METAL PARTS

TECHNICAL FIELD

The invention is concerned with the compaction of powder metal, in particular control of the processing parameters in the compaction of powder metal.

BACKGROUND OF THE INVENTION

There is a need to produce higher density powder metal parts. There are ways of coating or adding thin lubricants or polymer coatings as interfaces between the particles which decreases the internal friction and stresses created during compaction.

Some problems have arisen with different types of heating devices for powder metal. When heated to a temperature of about 300 degrees Fahrenheit before loading the material into the die cavity, the powder may become tacky and coagulate. Typical powder delivery systems have used mechanical devices; these systems have some drawbacks. Mechanical devices will cause some coagulating or snowballing of the powder due to tacky lube being rolled over and over. Air fluid beds will segregate the material due to sizes, weight variations in particles. Pleated hoses will allow material to gather in pleats and block the hose.

Since the usual production method requires accurate gravity controlled filling of the die cavity from the delivery shoe, the present invention designs around these known problems.

SUMMARY OF THE INVENTION

Described is a method of shaping powdered metal parts comprising providing powdered metal from a source, applying a heated fugitive coating to the powdered metal, passing the powdered metal through a heated tube from a supply thereof to the die for the molding of the part, monitoring the temperature of the heated tube during the passage of the powdered metal there though, heating and monitoring the temperature of the die, heating and monitoring the temperature of a punch die, and after filling the die with coated powdered metal, compacting the powdered metal by applying pressure from the punch die to the filled die, thereby compacting the metal to a desired shape.

DESCRIPTION OF THE PREFERRED EMBODIMENT

The present invention pertains to a powder metal material delivery system. Work pieces made at room temperature will have densities in the range of 6.8–7.1 g/cc. If the powder is pre-heated, the polymer and lubricated products will not only help obtain higher density at lower compacting pressures but also heating the die will decrease the ejection forces created by the higher density. Homogeneous part density levels greater than 7.4 g/cc can be obtained. Generally, by using heated powder and tools, it has been possible to increase density by about 0.2 g/cc.

The system utilizes a much simpler method of heating powder metal. In addition, the system integrates the heating of powder, tooling, and feed shoe as well as control of the external die lubrication system into a single controls package. The die is mounted into the horizontal die table with an opening in which the tool is mounted. The die has heaters inserted into it that control tool temperature and also aids in getting the internal lube from the powder to the die wall. A feed shoe is movable across the cavity to deliver raw material into the tool. The shoe is fitted with heaters and a thermocouple that controls the temperature of the raw material before entering the cavity. The fed shoe receives material from a heated or non-heated hose, that is gravity fed from the standard press hopper. The hose is used to pre-heat the material before entering the shoe.

A five or seven zone power controller controls all heaters and thermocouples. This controller is designed to operate as a stand-alone or PLC based system. The controller uses "DIN-A-MITE" (trademark of Watlow, Inc.) solid state power controller for each zone that can handle up to six heaters or two heated hoses. The controller is cycled by two options. One is PLC (programmable logic controller). When the thermocouple senses a need for heat the logic or algorithm will look at the temperature entered and the "PID," proportional band, reset integral, and rte/derivative (see page 7). Option two is a stand-alone system that uses a microprocessor-based control. The output of the thermocouples can be wired into the press controls to alert an operator of an error within the system.

Figure 1:
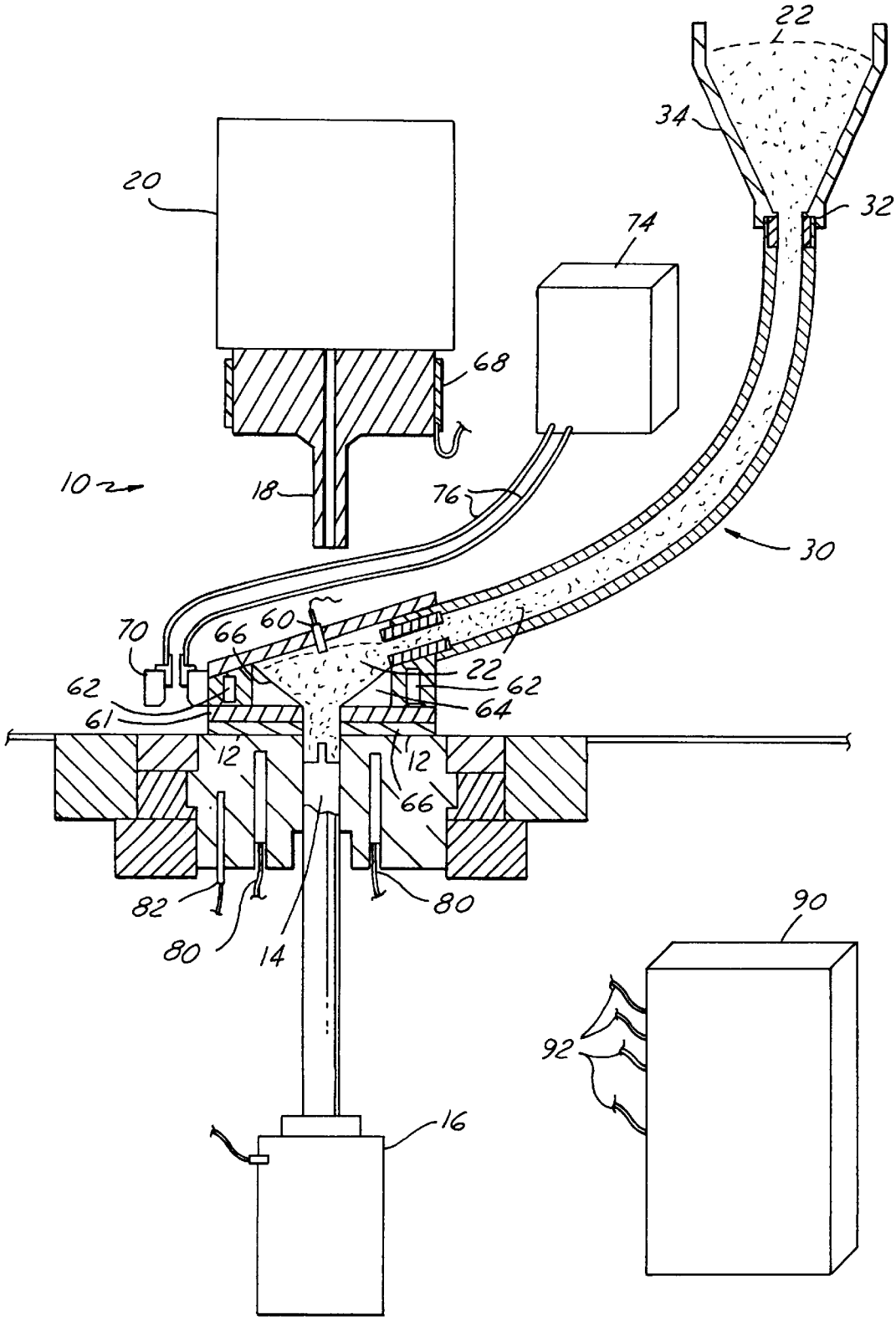
FIG. 1 is a schematic presentation of the powder metal compaction of the process of the present invention.
Figure 2:
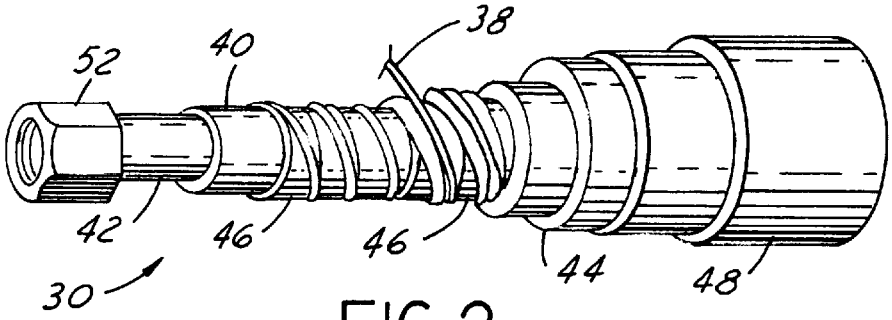
FIG. 2 is a sectional perspective view of the heated powder metal hose utilized to connect the supply of powder metal to the die utilized in the compaction process.
Figure 3:
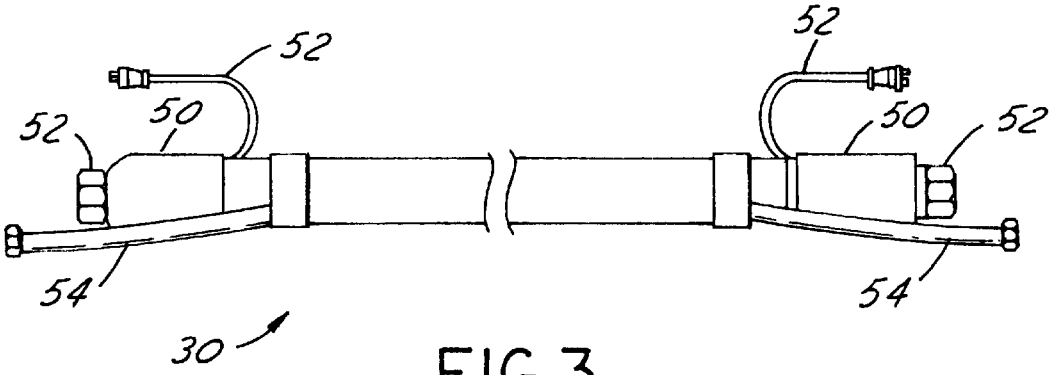
FIG. 3 is a sectional view of the hose of FIG. 2.

This invention provides a system for delivering material into a die cavity at room temperature of up to 500 degrees Fahrenheit (FIG. 1). The material is gravity fed from the hopper to a Teflon (trademark of E.I. DuPont) lined heated hose (FIG. 2) in which the powder is pre-heated before entering the closed hopper or feed shoe. On larger presses that required greater amounts of heated material, a hopper should be used. The system may use two hoses on a 750-ton press at over 20-lbs./minute of heated material. On smaller presses the single hose is attached to the shoe which has an inserted angle of repose to assist in the flow of the material into the die cavity.

The feed shoe is movable in a direction parallel to the table that will extend and retract. In the retract position a central bore will align with the hopper on a large press where it will be gravity filled with powder. The shoe in the extended position will align the central bore over the cavity and powder will drop into the die. On a smaller press the hose is attached to the shoe and when in the extended position as the powder flows into the cavity new material replaces it.

Mounted on the front of the shoe is a lube block. As the shoe extends, the feeder will stop over the cavity and the lube system will apply a given amount of lube. The die wall lubrication system permits powdered lubricant tube sprayed into a die cavity via a flow pump, timers and charge gun. The theory of operation allows three pressure regulators to be used to independently control lubricant discharge. The hopper air controls lubricant fluidization by an air pump. The charge gun air controls discharge velocity from the gun to the discharge block on the front of the shoe. Two timers are used to control the air blown through the gun, and the amount of lube applied. On a system, which uses a PLC, these timers are internal to the logic and are controlled by the program. Hopper air is set (3 to 5 psi) to create and fluidize the bed and prevents lubricant bridging. Lubricant air (10 to 15 psi) is used to control the pump draw vacuum from the lubricant hopper to the charge gun. Charge gun air (30 to 45 psi) is used to propel the lubricant from the pump through the charge gun, to the discharge block on front of the feed shoe. Because of the nature of the charge on the lubricant, it is advantageous to ground all tooling members to insure proper adhesion of the lubricant to the tooling surfaces. When heated tools are used, the lubricant adhesion will be strong enough that the powder flow into the cavity will not wipe lube to the bottom. Different lube melting points, as is well known in the art, may be used as tooling temperature changes.

Turning more to a discussion of FIG. 1, this invention provides a raw material feed system used in conjunction with a compacting press machine such as those typically used in powder metallurgy applications. In powder metallurgy applications, compacting press machines 10 include a table 12 with a hole (not shown) in which a die (14) is mounted. Tools can be mounted on lower platens 16 and are stationary to provide for different levels of parts. Upper tools punch die 18 are mounted on the ram 20. Powder metal 22 is placed in the die cavity to form the product when compaction takes place. The die table of the press generally lowers from the plane where compaction took place and the product is ejected from the die.

It is necessary to get the proper quantity of raw material in the die before the compaction process begins. The invention addresses the need to for an improved feed system delivering the raw material, which can be heated if the product requires higher density. The invention is directed towards a warm powder delivery system having a pre-heat hose 30 (FIG. #2) that receives powder metal from the discharge end 32 of the hopper (FIG. #1) attached to the press. To achieve uniform heating throughout the hose, watt density to achieve the required result is calculated based on the flow rate, exit temperatures required and core diameter. Nickel alloy wire 38 is spiral-wound around a stainless steel braid 40-reinforced hose core (42). The wire features insulation (44) between two layers of silicone tape 46 that is vulcanized to the steel braid reinforced hose core. A temperature sensor is mounted in contact with the core assembly to signal an external temperature controller. Thermal insulation 44 is spiral wrapped over the hose inner assembly to minimize the external surface temperature and provide a safe-to-handle hose surface. The assembly is encased within a wear-resistant, braided polyester jacket 48 for normally dry environments. Cuffs 50 are installed over both ends of the finished hose. A cable 52 extends from the hose to connect to a suitable power source (not shown). The ends have JIC female fittings for mounting 52. An airline 54 is used for cooling as desired.

If large amounts (over 10 lbs./minute) of raw material are required a lower heated hopper with two fittings for dual hoses may be used. The hopper is insulated and band heaters are used with a "J" type thermocouple 60 for heater control. The feed shoe 61 in the retract position will have a center bore which will align with the hopper bore to allow heated powder to gravity flow down in the shoe. When the feeder extends, the center bore will align over the die 14 and powder 22-will gravity fill the cavity. The shoe bore is fitted with an insert 64 which has an angle of repose 66 to assist in the flow of powder and reduce the amount of material which sets on the hot die. The shoe 61 is fitted on the bottom with a Teflon wear plate 66 that seals it to the die table 12. Heat is supplied with band heater 68 and thermocouple for control. The hose 30 is flexible and removable to allow for easy changing of materials. The tools, hose, hopper, and shoe are part of a PLC control system 90 setup to control up to 8 zones of heaters. Each zone can be turned on or off independent of the other zones. If the thermocouple for any zone is disconnected or open that zone will be disabled and indicate to the operator an error. Heater zones may be set for a cycle time of 5 seconds. The ability to compute the on state of heaters may be preset to check every 0.1 to 0.25 seconds. If heaters overshoot temperature, adjustments may need to be made to cycle time.

The external die lube distribution block 70 is made out of Teflon (trademark of E.I. DuPont) and is mounted to the front of the shoe so the feeder can be used for correct position over the die cavity. When the feeder stops, a signal is sent to the lube unit that starts the lubrication cycle. Different blocks may be necessary to allow for proper lube application. After the cycle is complete the feeder will continue to the given position, fills the die cavity, retract, and begin the compaction process.

The external lube system has a container 74 to which lubricant is supplied through tubes 76 to the lubrication distribution block 70.

The bottom die 12 has die heaters 80 as well as a die temperature monitor 82. The controller 90 for the different heating functions has various inputs and outputs symbolically shown as wires 92. The wires are turned attached to the different temperature controls and heating mechanisms and the PLC or microprocessor monitors the entire system.

Figure 4A:
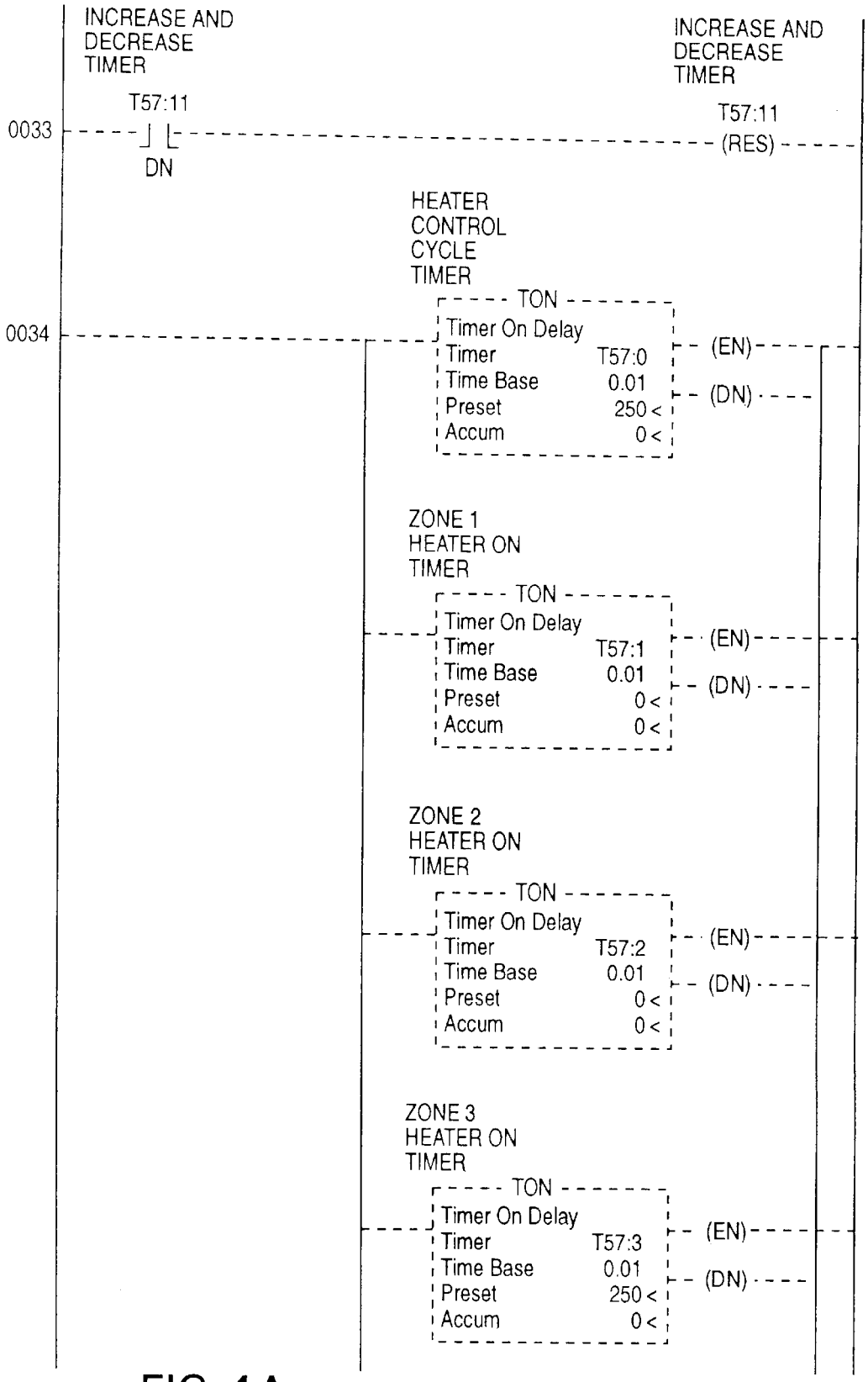
FIG. 4 is ladder diagram for a programmable logic controller used for modulating control of the heating units in the present invention.
Figure 4B:
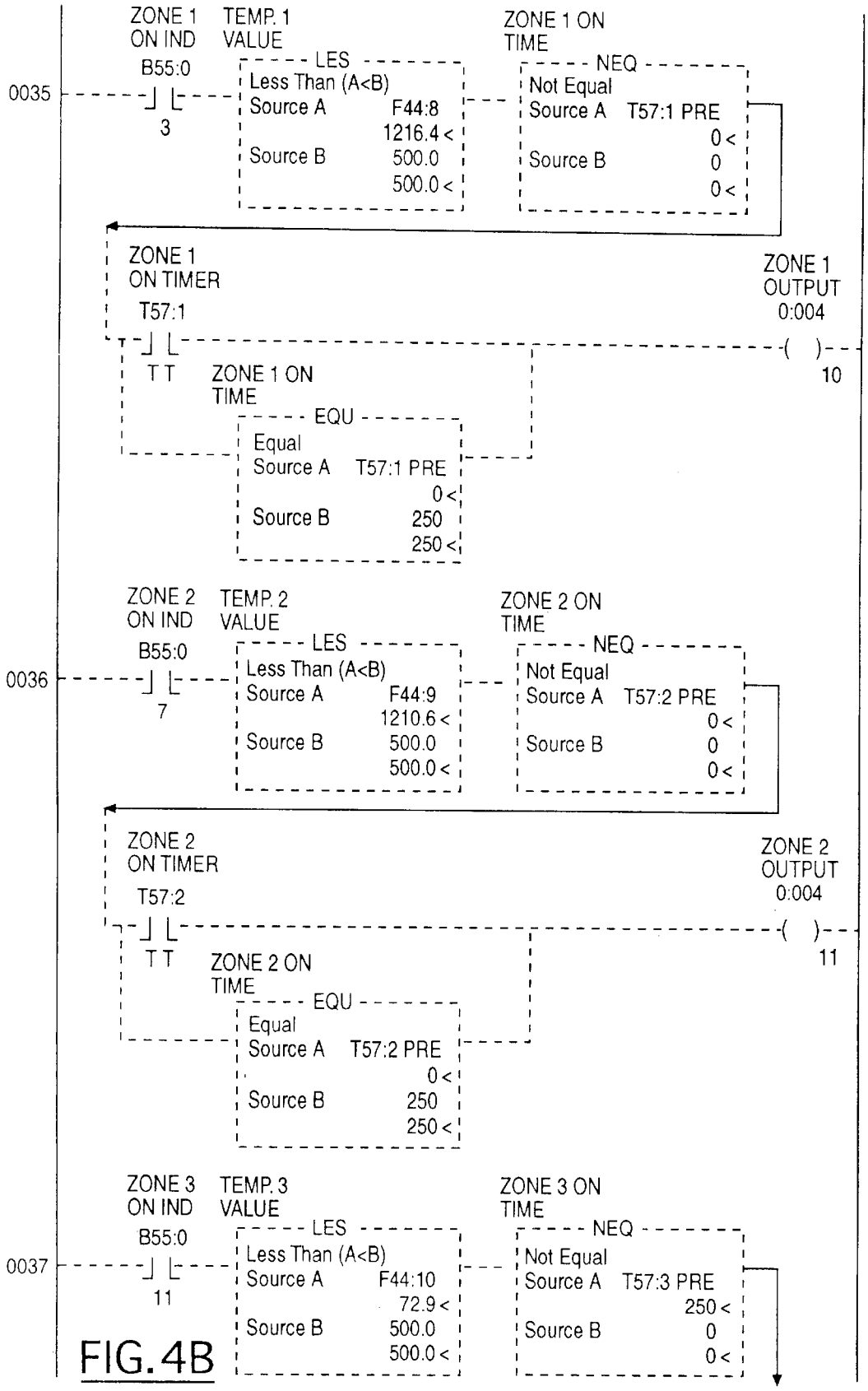

FIG. 4 is a ladder diagram of a portion of the monitoring performed in the compaction process of the present invention. The diagrams are the same for all heat measuring components of the process. Staring with rung 33 the program looks at the zone and the thermocouple and determines if it needs to be increased or decreased. The heater has a thermocouple that registers its temperature.

Within rung 34 the temperature cycle is 250-Milliseconds in the program pre-set, which is 2½ seconds. For every 2½ seconds, the PLC looks at all 7 zones and looks at the thermocouples and determines whether to increase or decrease temperature. This is preformed at rung 34, zone heater. If the heater is turned, the PLC looks at the time based every $10^{th}$ of a second. The PLC reviews all of the heaters. In rung 35, the value that is present pertains to source A and source B; source A is the thermocouple. The thermocouple next to that "NEQ" stands for a not equal. If the thermocouple is not equal to the number that is in source B, then there is a need to increase the heat. At that point, the algorithm in the PLC states that if the temperature is more than 15 degrees lower than the number that set, then it needs to increase the heat. The heater is adjusted such that it is 80% on time and 20% off time. This allows the system to stabilize so the monitoring of the thermocouple can take place the next 2½ seconds and act on it again.

If the temperature is 15 degrees away from that desired, then the heater is 80% on. If it is 10 degrees away it is 60% on. As the heater gets up to within 5 degrees of the heater set point it is 50% on. Theoretically it would be on for 50% of the 2½ seconds until it gets up to an equal, i.e., a set point. All zones are monitored depending on which heaters are turned on in FIG. 1. There are heaters in the top punch, in the shoe, in the die and the heated hose. All 7 zones are constantly monitored by the PLC.

Rungs 36 and 37 run in a similar fashion. Rungs 36 and 37 have zone 2 and zone 3 in the ladder diagrams of FIG. 4. Duplicate rungs are in effect in the PLC for up to zone 7. The ladder diagrams for these zones have the same logic as provided in register B55 of FIG. 4. The heater is turned on or turned off. If it's on, then the program operates i.e., look at the thermocouple and do the adjusting. If it is turned off, for instance, there are powders that are not heated; in that case all that is heated is the die. One has the option to turn off or on any part of the equipment and still continue to run the rest of the system.

In rung 36 there is a source A, F44: 9. F44 is an internal register; there are 16 bit registers and one has bit 1 through bit 16. In rung 35 there is F44, a bit 8, that is, where the PLC reads the thermocouple and puts the reading into that register from which other comparisons are made. Line T57 is a timer. It is actually a register with 16 bits within that register that can be reviewed.

The term "PRE" stand for pre-set i.e., what ever is pre-set in timer 57 bit 2, that is to what it will be reviewed. For example, source A is the thermocouple and it is set at, for example, 350 degrees F.; the PLC will look to the pre-set to monitor. Then the PLC turns the timer on, reviews at how far away is the heater temperature, sets the percentage and turns on the heater for that period of time until it comes up again until the temperature is equal to the pre-set temperature.

The powdered metal that is utilized in the compaction processes of the present invention is a wide variety of materials. They can be used to prepare correspondingly a wide variety of end products. The compacted powder metal products are formed of small iron or iron alloy particles, mixed with suitable thermoplastic binders and molding lubricants. By small is meant that the particles range in size from about 10 microns to about 250 microns.

By way of example and not by way of limitation, the iron powder particles used to make the subject end segments, may be a Hoeganaes 1000 B-PF iron powder which is blended with (1) a small amount (i.e., ca. 0.1% to ca. 1.0% by weight) of a fugitive binder, such as polyphenylene oxide (e.g., GE's Noryl), (2) a lubricant such as Carbowax, and (3) a strengthener such as $Fe_3P$. The particle sizes of the iron particles range from about 10 microns to 250 microns with the majority of the particles being larger than about 44 microns. The iron alloy comprises about 99.7% Fe, 0.003% C, 0.0005% N, 0.006% S and 0.004% P. One particularly effective such blend, employing an unknown binder, is sold by the Hoeganaes Corporation under the trade name ANCHORDENSE™ and described in Semel U.S. Pat. No. 4,834,800 issued May 30, 1989 and assigned to the Hoeganaes Corporation. Hoeganaes 1000 C, or Hoeganaes SC 40 are likewise useful iron particles for this purpose when mixed with appropriate lubricants and binders.

Alternatively, the mixture to be compacted/sintered may comprise iron particles, which have previously been coated with a fugitive binder (e.g., polyphenylene oxide) such as, described in U.S. Pat. No. 5,271,891, issued Dec. 21, 1993 in the names of D. E. Gay et al. One way of coating the particles is to dissolve the thermoplastic in a solvent to form a solution thereof. The iron particles are then blown upwardly through a vertical tube while, at the same time, the binder solution is sprayed into the tube to coat the particles. The solvent evaporates leaving the thermoplastic binder on the surface of the particles. The coated particles fall outside of the tube, and are repeatedly recirculated upwardly through the tube where they are coated again and again until a desired thickness of binder is achieved.

When polyphenylene oxide binders are used, the iron powder is preheated to about 290° F. before being introduced into the die, while the die itself is preheated to about 550° F. When other binders are used, different particle and die temperatures are required depending on the thermoplastic used. Hence, for example, when ANCHORDENSE™ particles are used the mold is only heated to about 350° F. The particles are compressed in the die at a pressure of about 50 to 55 tons per square inch for about 6 to 12 seconds in order to obtain densities of at least 7.4 g/cc (i.e., for both the base portion and the teeth). During compaction molding, the thermoplastic operates as a lubricant and serves to increase the density of the molded base/tooth. Upon cooling, the thermoplastic acts as a binder and serves to hold the particles together in the as-molded, "green" state.

This invention provides unique moldable ferromagnetic particles and a method of making a magnetizable molding therefrom, which molding comprises a plurality of ferromagnetic particles distributed throughout a matrix of a durable, substantially insoluble thermoplastic polymer such that each particle is insulated one from the next by such polymer. By "substantially insoluble" is meant either not soluble or so slightly soluble that a solution thereof contains too little dissolved polymer to adequately encapsulate the individual ferromagnetic so as to effectively insulate them from each other. A carrier solution for the insoluble polymer is prepared comprising a soluble, polymer binder (preferably a thermoplastic) dissolved in a suitable solvent. A plurality of small particles (i.e., smaller than the ferromagnetic particles) of the desired, substantially insoluble thermoplastic, matrix-forming polymer are mixed into the solution to provide a slurry of the insoluble particles suspended in the solution of soluble polymer. The ferromagnetic particles are then spray-coated (e.g., ala the Wurster process supra) with the slurry so as to coat the surfaces of each of the ferromagnetic particles therewith. Evaporation of the solvent from the solution then leaves a layer of the substantially insoluble thermoplastic polymer particles entrapped in a skin of the soluble binder polymer, which serves to adhere or "glue" the insoluble polymer particles onto the surfaces of the ferromagnetic particles. The insoluble thermoplastic particles will comprise a majority amount of the insoluble-soluble polymer layer. By majority amount is meant about 70% or more by weight. The thusly coated ferromagnetic particles are then placed in a mold, heated to the melt flow temperature of the insoluble polymer particles, and compressed under sufficient pressure to cause the ferromagnetic particles to coalesce with each other, and to flow over, around and between the ferromagnetic particles so as too insulate each from the next throughout the molding and to insure a substantially uniform distribution of the particles throughout the polymer. Cooling of the molded article solidifies the insoluble polymer matrix about the ferromagnetic particles.

The ferromagnetic particles will have an average particle size between about 5 microns and about 500 microns, depending on the nature (i.e., Fe, rare-earth alloy, ferrite, etc.) of the particles with an average particle size ranging between about 100–120 microns. Preferred such materials are commercially available from the Hoeganaes Company as grade 1000 C with an average particle size of about 100 microns or SC 40 Base Iron having an average particle size of about 180-micron. On the other hand, ferrites suitable for making hard magnets range in size from about 1 micron to about 100 microns with an average size of about 20 microns to about 60 microns. Likewise, rare-earth (e.g., iron-neodymium-boron) ferromagnetic particles for hard magnets will range in size from about 10 microns to about 300 microns with an average particle size of about 100–120 microns. The insoluble, thermoplastic particles clinging to the surface of the ferromagnetic particles will be much smaller than the ferromagnetic particles so that a multitude thereof are needed to cover the surface of each ferromagnetic particle. Such insoluble thermoplastic particles will vary in size from about 1 micron to about 30 microns with an average particle size of about 10–20 microns.

The soluble binder polymer will preferably be a thermoplastic, but need not be such, since it is used only in small quantities, which do not interfere with the molding process. In this regard, the amount of soluble binder polymer used to glue the insoluble polymer particles to the ferromagnetic particles will vary somewhat depending on the composition of the binder, and the composition and particle size of the insoluble polymer, but will preferably be only that amount which is needed to glue the insoluble polymer particles to the ferromagnetic particles. Hence, typically the binder polymer will comprise less than about 30% by weight of the soluble-insoluble polymer layer and preferably about 10% to about 25% by weight of the layer. Chemically, the soluble polymer will preferably be different than the insoluble polymer, but may in some instances be naught but a shorter chain, lower molecular weight species of the insoluble polymer, which variant is sufficiently dissolvable to function as the binder for retaining the insoluble polymer species on the surface of the ferromagnetic particles. Similarly, some suitable polymers are slightly soluble. If they are sufficiently soluble (i.e., at least about 20 weight percent of the polymer is soluble) to form an adequate binder film for the insoluble portion thereof, such polymers are within the scope of this invention and will perform the dual function of being both the soluble binder polymer and the insoluble matrix-forming polymer.

For permanent magnets, the ferromagnetic particles may comprise ferrites or rare-earth alloy magnet materials, or the like. For such permanent magnets, the preferred substantially insoluble, matrix-forming polymer will preferably comprise polyamides such as Nylon 6/6, Nylon 11, Nylon 6 and Nylon 12, or fluorocarbons such as tetrafluorethylene (TFE) and fluorinated ethylene-propylene (FEP). However, other insoluble polymers such as polyethylene terephthalate (PET), or polyphenylene sulfide (PPS), or slightly soluble polymers such as polyvinylidene difluoride (PVDF) [20% soluble in n-n-dimethyl acetamide], or polybenzimidazole (PBI) [20% soluble in 1-methy-2-pyrrlidinone (NMP) with lithium chloride] may also be used. The insoluble particles are suspended in a solution of a soluble polymer, which preferably comprises either polystyrene, or an uncured epoxy dissolved either in acetone or toluene, as appropriate to the particular soluble polymer. However, other soluble polymers such as polyacrylate, polycarbonated, or polyetherimide may also be used in conjunction with suitable solvents therefor such as methylene chloride or 1-methyl-2-pyrrlidinone, as appropriate to the particular soluble polymer. For such permanently magnetizable moldings, the insoluble, matrix-forming polymer will preferably comprise about 1.5 percent to about 4 percent by weight of the coated ferromagnetic particle, and the soluble polymer will comprise about 0.1 to about 0.2 percent by weight of the coated ferromagnetic particle.

For soft magnetic cores, the insoluble, matrix-forming polymer will preferably comprise polyphenylene sulfide, polyphtalamide, polybenzimidazole or certain polyamides (e.g., Nylon 6 or Nylon 66) and polyesters (e.g., polyethyleneteraphthalate or polybutyleneteraphthalate). For such soft magnetic cores, particles of the insoluble polymer will be suspended in a solution of soluble polymers such as polyetherimide (e.g., ULTEM™ from the General Electric Co.), polyamideimide (e.g., TORLON™ from Amoco Corp.), polyethersulfone (e.g., VICTREX™ from the ICI Americas Corp.), polystyrene (e.g., G2 from the Amoco Corp.) or any of a variety of silicones or acrylates (e.g., Acryloid B-66 from the Rhom & Haas Corp.) dissolved in a suitable solvent such as methylene chloride or any of a variety of other solvents such as acetone, toluene, or N-methylpyrrilidinone (NMP), as appropriate to the particular soluble polymer. In soft magnetic cores, the insoluble matrix-forming thermoplastic polymer will comprise about 0.4 to about 0.75 percent by weight of the coated ferromagnetic particle, and the soluble polymer will comprise about 0.1 to about 0.2 percent by weight of the coated ferromagnetic particle.

Partially soluble polymers may be used to function as both the soluble polymer and the insoluble polymer. Hence for example, polybenzimidazole is soluble in NMP with lithium chloride up to about 20 percent of its weight. The dissolved 20 percent is adequate to coat the ferromagnetic particles sufficiently to adhere or glue the insoluble component thereof onto the surfaces of the ferromagnetic particles, but inadequate to provide adequate encapsulating-insulating coating all by itself.

A number of patents describe the various end-uses of powdered metal compacting technology. Such as, U.S. Pat. Nos. 5,607,525; 5,637,402; 5,706,792; and 5,749,742, which are hereby incorporated by reference.

While the form of the invention herein disclosed constitutes presently preferred embodiments, many others are possible. It is not intended herein to mention all of the possible equivalent forms or ramifications of the invention. It is understood that the terms used herein are merely descriptive, rather than limiting, and that various changes may be made without departing from the spirit or scope of the invention.

What is claimed is:

1. A method of shaping powdered metal parts comprising:

(a) providing powdered metal from a source;

(b) applying a heated fugitive coating to the powdered metal;

(c) passing the powdered metal through a heated tube from a supply thereof to the die for the molding of the part;

(d) monitoring the temperature of the heated tube during the passage of the powdered metal there through;

(e) heating the die and monitoring the temperature thereof;

(f) heating a punch die and monitoring the temperature thereof;

(g) after filling the die with coated powdered metal, compacting the powdered metal by applying pressure from the punch die to the filled die thereby compacting the metal to a desired shape;

further comprising measuring the temperature of the powdered metal, the heated tube, the die for the mold part, and the punch die during processing every 0.1 to 0.5 seconds.

2. The method of claim 1 further comprising controlling the pressure of the punch die by releasing the pressure after the compacting step and repeating steps a) through g) of claim 1.

3. The method of claim 1 further comprising monitoring the pressure applied to the die during the compacting step.

4. The method of claim 1 wherein the powder metal is heated to a temperature of up to 500 degrees F.

5. The method of claim 4 wherein the temperature of the powder is detected every 0.1–0.5 seconds, and the temperature is increased or decreased in response to the measured temperature.

6. The method of claim 1 wherein the monitoring step is performed by a programmable logic controller.

7. The method of claim 1 is wherein the monitoring step is performed by a microprocessor.

* * * * *